United States Patent [19]

Lee

[11] 4,263,739

[45] Apr. 28, 1981

[54] DISPLAY SIGN ASSEMBLY

[76] Inventor: Yuan S. Lee, 1300 Santiago St., San Francisco, Calif. 94116

[21] Appl. No.: 139,015

[22] Filed: Apr. 10, 1980

[51] Int. Cl.[3] ..... G09F 15/00

[52] U.S. Cl. ..... 40/606

[58] Field of Search ..... 40/584, 607, 606, 10 R, 40/16.2, 612, 100, 16.4

[56] References Cited

U.S. PATENT DOCUMENTS

| | | | |
|---|---|---|---|
| 1,574,653 | 2/1926 | Holder | 40/618 |
| 2,032,561 | 3/1936 | Buehler | 40/617 |
| 3,115,325 | 12/1963 | Batcha | 40/617 |
| 3,216,580 | 11/1965 | Fricker | 40/164 |
| 3,529,798 | 9/1970 | Williams | 40/607 |
| 3,739,508 | 6/1973 | Lyles | 40/10 R |

*Primary Examiner*—Gene Mancene

*Assistant Examiner*—Wenceslao J. Contreras

*Attorney, Agent, or Firm*—Owen, Wickersham & Erickson

[57] ABSTRACT

A display arrangement for a sign, such as an "Exit" sign or the like, has a bracket secured to a wall or ceiling by screws or other fasteners which pass through a base of the bracket, with a mounting flange extending perpendicularly from the base in line with and between the fasteners. A display structure extends from the mounting flange, and consists of a pair of plexiglass or other opaque plastic plates spaced apart by a pair of separator bars between them. The mounting flange of the bracket fits closely between the plates of the display structure and is secured to the plates. The spacer bars are so arranged that access is permitted to the fasteners by means of a screwdriver or other tool inserted between the plates of the display structure.

7 Claims, 5 Drawing Figures

DISPLAY SIGN ASSEMBLY

BACKGROUND OF THE INVENTION

The invention relates to display apparatus, and more particularly to a sign or similar display item for extending perpendicularly to a wall or ceiling, and which may include resistance to tampering.

A problem with signs in public places is that if not permanently mounted to a wall or ceiling, they are susceptible to tampering and removal by vandals. This is true of signs which extend perpendicularly to the wall or ceiling, which if not permanently mounted, have typically been accessible for quick removal by means of a screwdriver or simple force. Efforts to overcome this problem have generally resulted in elaborate, costly and impractical structures. There has therefore been a need for a simple, attractive, inexpensively manufactured sign or display device for extending from a wall or ceiling, with resistance to tampering yet with the ability for removal by one familiar with the sign construction, perphaps with a special tool.

Various constructions of signs or display devices are shown in U.S. Pat. Nos. 4,165,572, 4,144,644 and 4,161,834, the latter of which is concerned with prevention of tampering or theft. However, no prior art display arrangement provides a practicable solution to the problem of tamper resistance in a display article which extends normally to a wall or ceiling, while still providing for removal of the article if necessary, for ease and economy of manufacture, and for a pleasing visual appearance.

SUMMARY OF THE INVENTION

The present invention solves the aforesaid problems by providing a sign or display arrangement for extending from a wall or ceiling, including a bracket for mounting on the wall or ceiling with a base for engagement against the surface of the wall or ceiling and a flat flange extending normally to the base generally in a vertical plane, the base being of greater length than the flange. Fasteners for engaging the wall or ceiling are positioned in and extend through the base adjacent to each end of the flange, in alignment with the flange. A structure which holds the display item is connected to and extends from the flange, being formed from a pair of plates of generally equal size arranged parallel to one another, with spacer means holding the two plates a fixed distance apart. The flange of the bracket is inserted into the display item at one edge, between the plates, being sized to fit closely therein, and the flange and plates are secured together so that the display item extends normally to the surface of the wall or ceiling. This construction substantially hides the fasteners from view and makes them substantially tamper-proof. Preferably, two spacers are provided holding the plates apart, spaced inwardly from the edges of the plates such that the bracket can extend in without interference and such that access to the fasteners is facilitated for a tool inserted between the plates. For simplicity of construction and for a pleasing appearance, the plates, spacers and bracket may all be of plexiglass or other plastic material, with th plates opaque, and with the base of the mounting bracket preferably transparent for an unobtrusive appearance on a wall or ceiling.

A display device produced according to this construction is of low cost, is relatively simple, is attractive and effective in displaying its message, and is resistant to tampering or removal by vandals, except with considerable time and effort. A special tool may be required to remove the fasteners, making unauthorized removal even more difficult.

These and other objects, advantages and features of the invention will be apparent from the following description of a preferred embodiment, taken in conjunction with the appended drawings.

DESCRIPTION OF A PREFERRED EMBODIMENT

Figure 1:
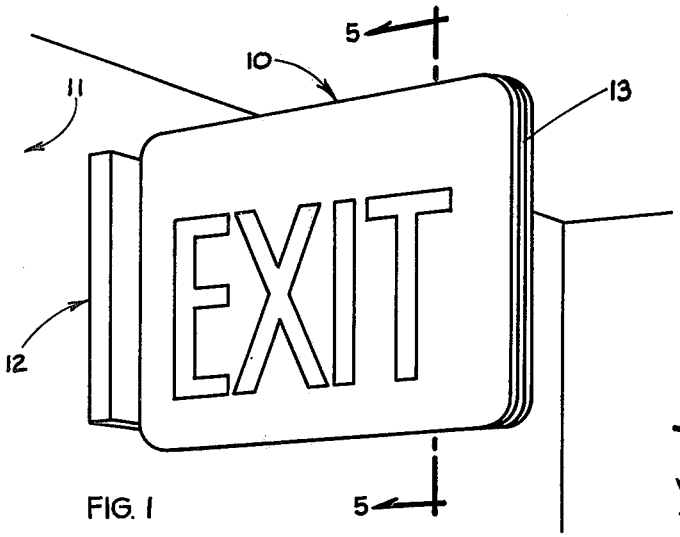
FIG. 1 is a perspective view of a sign or display arrangement according to the invention.

In the drawings, FIG. 1 shows a sign assembly or display arrangement 10 as mounted on a wall 11, the sign 10 being illustrated as an "Exit" sign as required in public buildings. Of course, the display device 10 could bear any desired symbol, logo, graphic design or message. The display assembly 10 includes a mounting bracket 12 secured to the wall 11 and a display assembly structure 13 connected to the mounting bracket 12 as described below.

Figure 2:
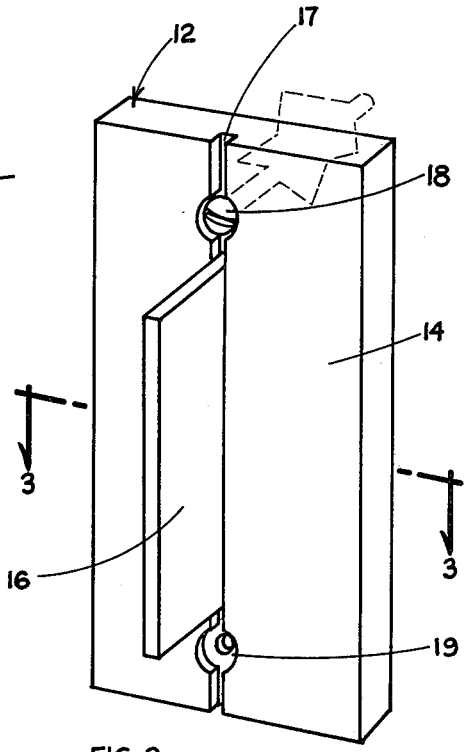
FIG. 2 is a perspective view showing a mounting bracket for securing to a wall or ceiling, forming a part of the display arrangement of the invention.
Figure 3:
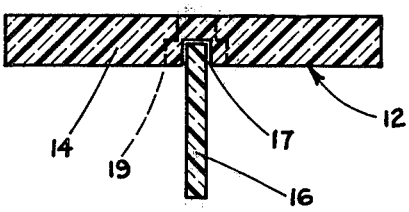
FIG. 3 is a sectional view of the mounting bracket, taken along the line 3—3 of FIG. 2.

FIGS. 2 and 3 illustrate the construction of the mounting bracket 12, which includes a base 14 and a mounting flange 16 extending normally to the base 14. As indicated, the flange 16 may be secured to the base 14 by insertion into a longitudinal groove 17 in the base 14. The groove 17 may extend the full length of the base as shown, for ease of production and versatility in assembly. The flange 16 and base 14 are preferably made of plexiglass or other plastic material, with the base 14 preferably transparent. The flange 16 is preferably secured in the groove by adhesion such as gluing, or by solvent bonding, in the case of similar plastics. If desired, the base 12 may be one integrally-formed piece.

The mounting bracket 12 is provided with a pair of fasteners 18 passing through countersunk bores 19 in the base portion 14, along the groove 17 as shown. The fasteners 18 may be screws, bolts, expansion bolts or spring-wing toggle type fasteners as are typically used for installation on plaster or sheet rock of building interiors. As indicated, the fasteners 18 are positioned just above and below the mounting flange 16, in line therewith. In the assembled display device 10, the fasteners are hidden from view, making an attractive arrangement. Of course, the terms "above" and "below" are used herein only for convenience in describing the assembly as shown in the drawings; the mounting bracket 12 could be mounted on a ceiling or other surface as well as on a wall.

Figure 4:
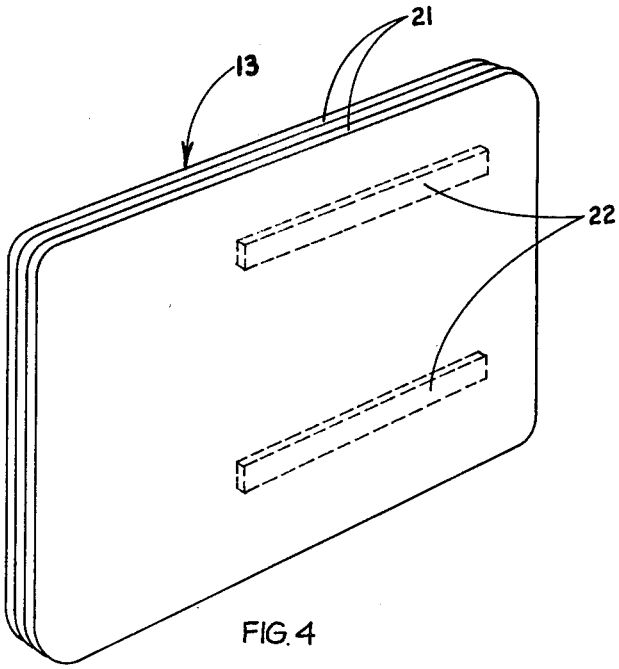
FIG. 4 is a perspective view showing a sign or display item for connection to the mounting bracket.
Figure 5:
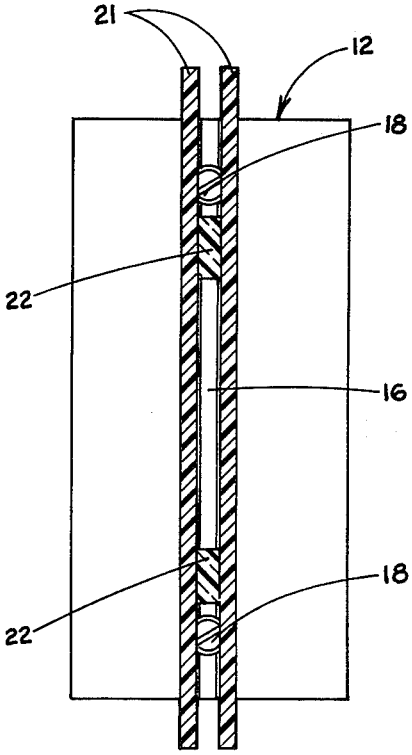
FIG. 5 is an end view of the display item, taken along the line 5—5 of FIG. 1.

FIG. 4 shows the display structure 13, comprising a pair of plates 21, preferably generally rectangular as shown, arranged in parallel relationship and spaced apart by a pair of spacer bars 22 positioned between them. The plates 21 preferably are opaque, and they and the spacer bars 22 may be of the same plastic material as the bracket flange 16. The spacing of the two plates 21, i.e., the thickness of the spacer bars 22, preferably is approximately the same as the thickness of the bracket flange 16, or slightly greater, so that the flange may be closely received between the plates 21 and adhered thereto, as by solvent bonding, gluing or tape secured to the flange 16 and having a sticky outer surface (not shown). FIG. 5 shows the flange 16 of the mounting bracket 14 received between the two plates 21. The spacer bars 22 do not extend as far as the position of the mounting bracket 16, and are not seen in FIG. 5. They may be only about half the length of the plates 21, and positioned as shown in FIG. 4, so that in the remainder of the display structure 13 the overlapping plate ends are flexible and are readily installed on the mounting flange 16, whether by gluing or tape adhesion. Of course, the spacers 22 could be oriented differently than as shown in FIG. 4, so long as they do not extend throughout the space between the plates 21. FIGS. 2 and 5 illustrate the fasteners 18 as positioned just above and just below the mounting flange 16. In the assembled display apparatus 10 (see FIG. 1), a long tool such as a screwdriver may be inserted between the parallel plates 21 to reach the fasteners 18 and remove them, when this is necessary. Thus, vandals and thieves would have a difficult time removing the display apparatus 10, except with the proper tool and considerable time and patience. If desired, the fasteners 18 can be spaced somewhat more closely together, so that access is possible only by inserting a tool, again between the plates 21, but at more of an angle to the edges of the plates 21 and the spacer bars 22. Thus, removal is somewhat more difficult except for the familiar mechanic, and the device is even more vandal-proof.

The entire assembly 10 may be made of plexiglass, and solvent bonded together for a simple and inexpensive construction, and a pleasing appearance. Alternatively, tape (not shown) may be used to adhere the plates 21 to the mounting flange 16, providing a stable bond but not being quite as tamper-proof as with a permanent bond. Wording, designs or other information for the display device 10 may be included on the outer surface of one or each of the plates 21.

It should be understood that other materials than those discussed above may be used in the construction of the display apparatus 10 of the invention. For example, in many instances it may be desirable to have display structure plates 21 of wood, or at least with an outer surface of wood, to match surrounding decor. The base 12, though usually of clear plastic so as to be nearly invisible, may be of a more prominent material and of any decorative shape desired. Metal or wood may be preferred in some locations.

To those skilled in the art, various changes in construction and modified embodiments and applications of the invention will be apparent without departing from the essence and scope of the invention. The described embodiment is illustrative of the principles of the invention but is not intended to be in any sense limiting.

I claim:

1. A display arrangement for a sign or the like, comprising:

a bracket for mounting on a surface, having a base for engagement against the surface and a flat flange extending normally to the base generally in a vertical plane, said base being of greater length than the flange;

surface-engaging fasteners positioned in and extending through the base adjacent to each end of the flange and in alignment with the flange; and a display structure connected to and extending from the flange, formed from a pair of plates of generally equal size arranged parallel to one another, a display item being included on at least one of the plates, with spacer means holding the two plates a fixed distance apart, said distance being approximately the same as the thickness of the flange of the bracket;

said flange of the bracket being inserted into the display item at one edge, between the plates, and secured to the plates so that it extends normally to the surface on which the bracket is mounted;

whereby the fasteners are substantially hidden from view and are substantially tamper-proof.

2. The display arrangement of claim 1, wherein the spacer means comprises at least one spacer bar positioned between the plates and spaced inwardly from the plate edges such that access to the fasteners is facilitated for a tool inserted between the plates.

3. The display arrangement of claim 2, wherein two spacer bars are included, positioned parallel to one another and receded from one end of the display structure sufficiently to accommodate the mounting flange.

4. The display arrangement of claim 3, wherein the base of the mounting bracket is of clear plexiglass.

5. The display arrangement of claim 1, wherein the entire assembly is of similar plastic material.

6. The display arrangement of claim 1, wherein the base of the bracket includes a groove extending longitudinally, with the flange secured in the groove.

7. The display arrangement of claim 1, wherein the plates of the display structure, in the dimension parallel to the length of the flange and the base, are of greater length than the flange and of at least the same length as the base.

* * * * *